US008394188B2

(12) United States Patent
Jannicke

(10) Patent No.: US 8,394,188 B2
(45) Date of Patent: Mar. 12, 2013

(54) SELF-COMPRESSING ASPHALT MIXTURE, IN PARTICULAR MASTIC ASPHALT MIXTURE, FOR ROADWAY TOPCOATS, ASPHALT INTERMEDIATE LAYERS, ASPHALT BINDER LAYERS AND/OR ASPHALT SEALING LAYERS

(76) Inventor: Bernd Jannicke, Cologne (DE)

( * ) Notice: Subject to any disclaimer, the term of this patent is extended or adjusted under 35 U.S.C. 154(b) by 0 days.

(21) Appl. No.: 13/197,113

(22) Filed: Aug. 3, 2011

(65) Prior Publication Data

US 2012/0195684 A1 Aug. 2, 2012

Related U.S. Application Data

(63) Continuation of application No. PCT/EP2010/000657, filed on Feb. 3, 2010.

(30) Foreign Application Priority Data

Feb. 3, 2009 (DE) ..... 10 2009 007 301

(51) Int. Cl.
*C08L 95/00* (2006.01)

(52) U.S. Cl. ..... 106/284.01; 106/281.1; 106/284.04

(58) Field of Classification Search ..... 106/281.1, 106/284.01, 284.04
See application file for complete search history.

(56) References Cited

U.S. PATENT DOCUMENTS

| | | | | |
|---|---|---|---|---|
| 3,776,748 | A * | 12/1973 | Richards | 106/284.01 |
| 3,941,607 | A * | 3/1976 | Schuhbauer et al. | 106/284.01 |
| 4,371,400 | A * | 2/1983 | Muller et al. | 106/273.1 |
| 4,997,483 | A * | 3/1991 | Kadelka | 106/670 |
| 5,122,009 | A * | 6/1992 | Vivier | 404/31 |
| 2006/0106138 | A1 * | 5/2006 | Trommelen et al. | 524/59 |
| 2008/0168926 | A1 * | 7/2008 | Muller et al. | 106/668 |
| 2009/0318602 | A1 * | 12/2009 | Deneuvillers | 524/425 |

FOREIGN PATENT DOCUMENTS

| | | | |
|---|---|---|---|
| DE | 1 926 808 | | 10/1970 |
| DE | 1 769 198 | | 3/1971 |
| DE | 23 29 689 D3 | | 1/1974 |
| DE | 195 38 774 | C1 | 11/1996 |
| EP | 2246473 | A1 * | 11/2010 |
| FR | 1.005.827 | | 4/1952 |
| FR | 69.21085 | | 4/1971 |

OTHER PUBLICATIONS

Abstract of DE 2329689, Jun. 1973.*
Abstract of FR 2050761, Mar. 1971.*

* cited by examiner

*Primary Examiner* — Helene Klemanski
(74) *Attorney, Agent, or Firm* — Dascenzo Intellectual Property Law, P.C.

(57) ABSTRACT

Self-compressing asphalt mixtures, in particular according to the mastic asphalt principle, and in particular mastic asphalt mixtures for roadway topcoats, asphalt intermediate layers, asphalt binder layers and/or asphalt sealing layers used in road construction. Roadway topcoats, asphalt intermediate layers, asphalt binder layers, and/or asphalt sealing layers containing such asphalt mixtures, methods for forming the same, and methods for transporting the asphalt mixtures, such as to an installation site, are also disclosed.

19 Claims, No Drawings

SELF-COMPRESSING ASPHALT MIXTURE, IN PARTICULAR MASTIC ASPHALT MIXTURE, FOR ROADWAY TOPCOATS, ASPHALT INTERMEDIATE LAYERS, ASPHALT BINDER LAYERS AND/OR ASPHALT SEALING LAYERS

RELATED APPLICATION

The present application is a continuation of, and claims priority to, PCT Patent Application No. PCT/EP2010/000657, which was filed on Feb. 3, 2010, and which claims priority to German Patent Application No. 10 2009 007 301.9, which was filed on Feb. 3, 2009. The complete disclosures of the above-identified applications are hereby incorporated by reference herein.

BACKGROUND OF THE DISCLOSURE

General information on the laying of roadway topcoats, asphalt intermediate layers, asphalt binder layers and/or asphalt sealing layers from asphalt mixtures is presented in "Technical delivery conditions for asphalt mixtures for the construction of public thoroughfare paving" (TL Asphalt StB 07, 2008 version). Classifications for grain sizes from stones to stone dust (fillers) are found in "Technical delivery conditions for stone sizes in road construction" (TL Stones-StB 04, 2007 version). There one also finds the designations for the different stone classifications.

Roadway topcoats, intermediate layers, binder layers and/or sealing layers made of asphalt are differentiated between two installation methods, rolled asphalt and mastic asphalt.

Rolled asphalt gets its name because it must in general be compressed by heavy rollers, with or without vibration, after installation and precompression. On the other hand, mastic asphalt can be poured, distributed, and installed in its final position with an installation machine (mastic asphalt screed or road paver), and thus need not be compressed. Due to its properties during installation, mastic asphalt is already prepared so that compression by heavy rollers is not required.

With rolled asphalt the mixture already contains the aggregate (stone chippings and sand) to create a textured road surface of the roadway topcoat that is rich in stone chippings causing it to have good gripping properties. Rolled asphalt must nonetheless be compressed by means of heavy rollers to the degree of compression required by rules and standards. Incomplete compression of rolled asphalt after installation is a primary cause of damage to roadway topcoats. It is often the case that installation errors occur due to unfavorable installation conditions, e.g., incomplete compression.

The technical shortcomings of rolled asphalt installation argue in favor of using mastic asphalt to lay roadway topcoats, intermediate layers, binder layers and/or sealing layers, especially for road construction. Roadway topcoats, intermediate layers, binder layers and/or sealing layers are thus all types of covering layers, intermediate layers, binder layers, and sealing layers encountered in road building, including situations in which the respective layers are not driven on in the narrower sense. It also includes all types of miscellaneous surfaces, even on bridges and in tunnels.

Mastic asphalt is a mixture of stone chippings, sand, filler, and binding agent. The filler is formed from the smallest grain sized powdered stone <0.063 mm (TL stone-StB 04, 2007 version), which is generally used as the binding agent in bitumen. This mixture is composed so that it can be poured and coated during installation, and can thus also be used as a mastic asphalt floor screed. No further compression is required after installation and finishing of the mastic asphalt layer.

Mixtures, and particularly mineral mixtures, general aggregate mixtures of class 0/8 (with a maximum grain size of 8 mm) or 0/5 (with a maximum grain size of 5 mm) or even 0/3 (with a maximum grain size of 3 mm) are appropriately used in road construction as a function of the surface properties. These mixtures are of special significance for roadway topcoats optimized for low noise properties. The grain size is important for determining the surface properties, tire gripping characteristics, rolling properties and noise produced by the roadway topcoat. They play a subordinate role with regard to stability, since this is primarily determined by the coating, which consists mainly of sand, filler, and binding agent.

Due to its favorable installation and flow properties, a roadway topcoat made of a mastic asphalt mixture would have a closed, smooth surface. This would not be well suited for driving. Stone chippings must therefore be provided for a roadway topcoat. In order to increase the roughness and tire gripping capability of the surface, it is conventional practice with mastic asphalt to scatter stone chippings or sand, which must be worked into the surface.

The application of scattered stone chippings with mastic asphalt requires the operational steps of heating, encasing with bitumen, transport and storage at the jobsite, scattering a specified quantity (12-15 kg/sqm), kneading with a rubber roller, rerolling with a smooth roller, sweeping, collecting, and transporting the excess scattered stone chippings away. Risks to tire gripping capability, noise production, and driving comfort also result from this sequence of procedures. If the mastic asphalt mixture has too much mortar on the surface, then the scattered stone chippings will sink into it. If too thin a coating is applied to the surface, then the subsequently scattered stone chippings will not adhere. This can also produce rough surfaces due to different installation thicknesses and excessively low temperatures, or even improper rolling.

Nonetheless, mastic asphalt is the most economical and most durable roadway topcoat made of asphalt for high traffic areas. The binding agent, namely bitumen, is protected from oxidation and subsequent embrittlement by the impermeability of mastic asphalt, and water is prevented from penetrating into the road structure.

More recently mastic asphalt mixtures have also been adapted in a modified procedure to make roadway topcoats. This mastic asphalt, which has improved noise qualities, is processed at 10 to 13 kg/sqm of scattered stone chippings (coarse aggregate) having special properties with respect to grain size and shape. These scattered stone chippings are not yet rolled. The installation of this type of mastic asphalt mixture is very difficult, however, since all installation parameters, such as installation temperature, absence of precipitation even on the day before the installation, proper temperature of the hot scattered stone chippings, must be maintained.

DETAILED DESCRIPTION AND BEST MODE OF THE DISCLOSURE

According to the rules and standards, "Technical delivery conditions for asphalt mixtures for the construction of bases for public thoroughfares" (TL Asphalt-StB 07), the following formulation for mastic asphalt mixtures is stipulated and allowed (M.-%, or "mass %," is the percent of the mass of the component to the total mass of the sample or mixture). This definition is valid for the object of self-compressing mastic asphalt mixtures of this invention, but for the requirements of the definition of the total mass of the mixture in the sense of said prior art according to TL Asphalt-StB 07, as well as the mixture of the additional embodiments of the invention presented below, is understood to be such a mixture except for the binding agent).

Stone chippings content (coarse aggregate >2 mm) between 35 M.-% and 55 M.-%,

Sand content (natural and/or crushed sand; grain size >0.063 mm, <2 mm) between 25 M.-% and 45 M.-%, Filler content (fine aggregate <0.063 mm) between 20 M.-% and 32 M.-%, so that a total mass of 100 M.-% results for the aggregate mixture, and Binding agent content between 6.8 M.-% and 8.5 M.-%.

In the sense of the present invention, stone chippings are understood to be a coarse aggregate in all generality >2 mm, and sand is a fine aggregate in a region between >0.063 mm and ≦2 mm. Stone chippings can thus also be present in mixtures having an aggregate in the range of >1 mm and <2 mm. Such mixtures that can be used according to the invention can thereby, e.g. have an aggregate in the range >1 mm and ≦3 mm. The stone chippings and/or sand in the sense of the present invention can thus not only be formed from stone, but also substitutes like, for example, granulated rubber, which may be made for example from processed automobile tires. Nonetheless, in the present invention aggregates will be used exclusively for the grain size ranges, even when substitutes like granulated rubber having appropriate grain sizes are used.

A small percentage of natural asphalt is also often added. In addition, additives and/or aggregates are added in different amounts, in part also to alter the viscosity of the bitumen so that processing can take place at a somewhat lower installation temperature.

Although rolled asphalt can be transported by ordinary trucks to the installation site, transport of the hot mastic asphalt to the installation site requires the use of special mastic asphalt mixing vessels. These are specially equipped trucks having transport containers that continuously stir the mastic asphalt mixture and maintain it at its optimal temperature, specifically somewhat higher than the installation temperature. The transport of mastic asphalt mixtures is thus more expensive than that of rolled asphalt mixtures.

The invention is based on the problem of providing a self-compressing asphalt mixture for roadway topcoats, asphalt intermediate layers, asphalt binder layers and/or asphalt sealing layers, which among other features eliminates the expensive scattering with stone chippings in a second operational step during installation, but nonetheless has favorable properties with respect to flatness, noise reduction, and tire gripping capability. A suitable roadway topcoat, asphalt intermediate layer, asphalt binder layer and/or asphalt sealing layer is likewise an object of the invention. Also the process for laying such a roadway topcoat, asphalt intermediate layer, asphalt binder layer and/or asphalt sealing layer is to be improved. Finally, the transport of such a mastic asphalt mixture for roadway topcoats, asphalt intermediate layers, asphalt binder layers and/or asphalt sealing layers, is to be optimized with respect to the prior art.

The previously described problem is solved by a self-compressing asphalt mixture, in particular by a mastic asphalt mixture, according to the present invention. The asphalt mixture according to the invention thereby has the following composition:

Stone chippings content having a grain size >1 mm, preferably >2 mm, between 60 M.-% and 80 M.-%, and preferably between 65 M.-% and 75 M.-%, Sand content of natural and/or crushed sand having a grain size in a range >0.063 mm and ≦2 mm, preferably ≦1 mm, between 2 M.-% and 15 M.-%, and preferably between 6 M.-% and 12 M.-%, Filler content having a fine aggregate ≦0.063 mm between 12 M.-% and 25 M.-%, preferably between 15 M.-% and 20 M.-%, and more preferably between 15 M.-% and 19.5 M.-%, Binding agent content between 6.0 M.-% and 8.5 M.-%, preferably between 6.8 M.-% and 7.5 M.-%.

The essential feature of the invention is thus a modified composition of the asphalt mixture compared to the formerly conventional values presented above. It is essential that the asphalt mixture according to the invention is a fine grained mortar highly enriched with the binding agent (the mortar being defined as a mixture of binding agent, filler, and sand). The asphalt mixture according to the invention can be used in applications for laying roadway topcoats, which represents the main application, asphalt intermediate layers, asphalt binder layers and/or asphalt sealing layers, in particular for road construction, in particular as sealing layers under open pore asphalt or other covering layers having large void fractions, and also in the binder region of roadways as the asphalt intermediate layer or asphalt binder layer due to its high stability, or as an asphalt sealing layer.

The mastic asphalt mixture according to the invention is also made preferably as class 0/8 (with a grain size of 8 mm) or 0/5 (with a grain size of 5 mm). However, it is also possible to use smaller maximum grain sizes, for example 3 mm or 4 mm, or larger maximum grain sizes, for example 11 mm or 16 mm, i.e., in particular one having a maximum grain size in a range of ≧2 mm through ≦16 mm.

According to an especially preferred teaching of the invention, it is provided that the sand content of natural and/or crushed sand having a grain size ≦2 mm, preferably <1 mm, and more preferably >0.063 mm and ≦1 mm, lies between 6 M.-% and 12 M.-%. That is an especially preferred classification that contributes to the optimization of the asphalt mixture according to the invention. Even more preferably, a sand having stone chippings in a range of ≧1 mm or <2 mm is available only to a small extent in the asphalt mixture, preferably in a range of 0.1 M.-% to 3 M.-%, wherein this quantity is surrounded by the total sand content in a range of 2 M.-% to 15 M.-%, preferably 6 M.-% to 12 M.-%.

The sand content preferably consists predominantly of natural sand, when possible in the form of quartz sand. Crushed sand, in particular made from the oversized grains of the filler and the undersized grains of the stone chippings, should preferably form only a very small component of the sand portion. The sand content preferably has a flow coefficient <30 (according to DIN EN 933-6, section 8).

As for the filler, it is especially advantageous when it consists predominantly or exclusively of limestone filler; which is a stone dust made of limestone (limestone dust). This leads to the desired mortar characteristics in the asphalt mixture. In addition, it is also possible to partially or totally replace it by fillers made from other rocks or replacement materials like glass, metal(s), plastics, fly ash, and in particular those having specific properties (for example, hardening).

The mastic asphalt mixture according to the invention already contains the aggregates that determine the surface properties in the asphalt mixture. This is reflected in the intrinsic increased stone chippings concentration having aggregate sizes >1 mm, preferably >2 mm. The aggregates determining the surface qualities of the roadway topcoat and, insofar as necessary, the intermediate layer, binder layer and/ or sealing layer, no longer need to be applied as scattered materials in an additional operational step.

For the mastic asphalt mixture according to the invention, the binding agent is a bitumen or at least a thermoplastic binding agent or mixtures of this binding agent, preferably a bitumen for the production of lower temperature asphalt (see data sheet for the temperature reduction of asphalt (MTA), 2006 version), a polymer-modified bitumen according to DIN EN 12591 or a bitumen for road construction.

Finally, it is also true for the asphalt mixture according to the invention that the viscosity of the bitumen is reduced and/or altered by the use of viscosity modifying binding agents, or by the use of viscosity modifying additives to the binding agent, and the installation temperature of the asphalt mixture can thereby be reduced. In particular, a lower installation temperature is reached in the range of approximately 160° C. to about 180° C. or to about 190° C. as compared to a previous lower temperature limit of about 200° C. to about 230° C. for the asphalt mixture according to the invention by means of suitable additives (after mixing and transport).

In order to lay roadway topcoats it is essential that the mastic asphalt mixture according to the invention not be subjected to an additional scattered layer, even though it is much less sensitive with respect to maintaining the installation parameters than the originally described asphalt mixture with improved noise properties, or even than the conventional rolled mastic asphalt.

The object of the invention is also a method for laying a roadway topcoat, intermediate layer, binder layer and/or sealing layer from a self-compressing mastic asphalt mixture according to the invention.

According to a preferred teaching of the invention, the mastic asphalt mixture having a temperature between approximately 160° C., preferably about 180° C., and 230° C., more preferably 180° C. and about 200° C. is installed on a substrate for laying a roadway topcoat, asphalt intermediate layer, asphalt binder layer and/or asphalt sealing layer, wherein the concept of a substrate also includes the roadbed. This refers to the installation temperature of the mastic asphalt mixture. The installation method using a road paver or mastic asphalt screed enables the asphalt sealing layer mixture to be produced in cross sections having different properties, in particular for the configuration of the void content and air pores, and also impermeability. Thus, a conventional dense mastic asphalt mixture is laid in the lower region. In the middle region it is advantageous to use a low void component supported by a mastic asphalt with stone chippings. The uppermost region of the asphalt sealing layer more closely resembles an open pore asphalt in its void component. This cross sectional distribution combines the advantages of all three covering layer mixtures into a single layer.

According to the invention, the second operational step of scattering with stone chippings required for a roadway topcoat is eliminated by an asphalt mixture according to the invention. The asphalt mixture according to the invention, as well as the mastic asphalt of the prior art, is installed without additional compression by rollers. Since the second operational step is eliminated, the use of rubber rollers and heavy smooth rollers is also eliminated.

According to a preferred teaching of the invention, it is only desirable that a post-treatment of the asphalt mixture installed on the substrate be carried out with a light smooth roller, preferably a light smooth roller weighing less than 6 tonnes, and in particular less than 4 tonnes. This treatment produces only an orientation of the stone chippings lying on the surface. It is not comparable to the effort required in the second operational step with prior mastic asphalt mixtures.

It is possible in principle to install the mastic asphalt mixture according to the invention on a suitable substrate (for example, an asphalt binder layer) with a conventional heavy mastic asphalt screed. It has been determined, however, according to the invention that the present asphalt mixture can also be installed differently, namely such that the mechanical installation is carried out with a preferably light conventional street paver used for rolled asphalt still to be compressed. It should thereby preferably be provided that the road paver is used to produce a slight prior precompression of the existing roadway topcoat. The road paver preferably installs the asphalt layer with a precompression of approximately one third the maximum by the first compression unit of the road paver. It is also preferable that no additional compression equipment of the road paver be used.

A roadway topcoat, intermediate layer, binder layer and/or sealing layer made from the mastic asphalt mixture according to the invention has a comparatively high stability and high deformation resistance. Appropriate testing has yielded excellent values.

Another positive property of the mastic asphalt mixture according to the invention is the fact that it is possible, in contrast to mastic asphalt installation procedures, to spray the substrate with an adhesive or with a bitumen emulsion for better layer adhesion. In addition, it is also possible to install the asphalt mixture according to the invention on a moist substrate. The vapor produced escapes through the finest pores without affecting the bonding. The coating remains dense in the lower region of the cross section like a conventional mastic asphalt.

A special advantage of the mastic asphalt mixture according to the invention and making the roadway topcoat from it is that lane markings can be applied immediately after laying the roadway topcoat. In contrast to the asphalt mixture treated with scattered stone chippings, a new lane marking need not be reapplied later after several weeks or months.

An objective of the invention is also a method for transporting the mastic asphalt mixture to an installation site where it is to be installed as a roadway topcoat, intermediate layer, binder layer and/or sealing layer. For this transport method it is advantageously possible according to the invention that the transport means be accomplished by conventional (normal) trucks, where applicable with built-in insulating and/or heating devices, thus by trucks without a mixing device for the asphalt mixture, in particular for mastic asphalt mixtures.

It is also fundamentally possible to transport the mastic asphalt mixture according to the invention in the asphalt cookers used for well-known mastic asphalt mixtures, and thus to maintain a higher temperature with continuous stirring. Due to its different composition, it is not recommended that the asphalt mixture according to the invention be subjected to continuous and particularly intensive stirring in a mastic asphalt cooker. The mastic asphalt mixture according to the invention remains stable even during transport over long time periods and exhibits only minor tendencies, if any at all, to settle or form a sediment.

The mastic asphalt mixture composed according to the invention, compared to conventional mastic asphalt, allows the lower installation temperature limit to be reduced by about 50° C., preferably 30° C., to a lower limit of about 160° C. to about 180° C. and thus reduces the emission of $CO_2$.

Contrasting the well known method of laying a roadway topcoat of rolled mastic asphalt and the method according to the invention, the two systems can again be compared to one another:

The conventional installation of a roadway topcoat made of rolled mastic asphalt generally occurs as follows:

laying two edge strips made of mastic asphalt having a width of 0.5 m each as the edge boundary and as a support for the track assembly of the mastic asphalt screed, installation of the mastic asphalt mixture using the mastic asphalt screed, with a maximum grain size as determined by the final application, application of the scattered stone chippings having a density of 12 to 15 kg/sqm, kneading of the scattered stone chippings by means of a rubber tired roller with simultaneous prevention of bubble formation in case of a moist substrate, smoothing unevenness that arises from using the rubber tired roller by means of a heavy, wide smooth roller, sweeping and disposing of the swept scattered stone chippings, applying a temporary marking to allow traffic to flow, which must, however, be replaced after a time due to the loss of stone chippings from the surface, cutting and pouring the joints between the roadway topcoat and edge strips.

If a typical road paver for rolled asphalt is used that eliminates the use of treads, particularly on the outside, for laying a roadway topcoat from the asphalt mixture according to the invention, the method according to the invention then reduces to two operational steps:

setting the road paver to a light precompression (in particular, to approx. ⅓ of the maximum of the first precompression unit) with respect to the intended thickness of the asphalt mixture, and installing the asphalt mixture using the road paver in its full installation width (no external track assembly) as the roadway topcoat, lightly rolling the surface of the roadway topcoat with a light smooth roller to orient the crushed grains lying on the surface.

The final lane marking can be applied immediately to the surface described here, since no scattered stone chippings are present that would have to be swept away.

Even while using a conventional mastic asphalt screed, the method according to the invention is still much more effective than the known method for laying a roadway topcoat. Then only the operational steps required for forming the edge strips for the track assembly of the mastic asphalt screed appear. The advantages of an even surface, tire gripping capability, and marking remain.

EMBODIMENT

The following formulation has been proven experimentally:

20.0 M.-% limestone filler ≦0.063 mm (Manufacturer: Hastenrather Kalkwerke Wwe. Wilhelm Meyer GmbH & Co. KG, 52249 Eschweiler, Germany);

4.0 M.-% natural sand >0.063 mm, ≦2 mm, flow coefficient 28 (Manufacturer: ABB Asphalt-, Beton- and Baustoffhandel e. K., Hasenbuschstr. 46, 52531 Übach-Palenberg, Nordrhein-Westfalen, Germany);

76.0 M.-% stone chippings (basanite), PSV 52, >2 mm, ≦5 mm (Manufacturer: Andernacher Lavakontor GmbH & Co. KG Lavawerk, Eicher Str., 56645 Nickenich, German); rough density of the resulting aggregate mixture (100 M.-% of the aggrgate mixture) 2.846 g/cm$^3$ 7.0 M.-% bitumen for making low-temperature asphalt, Sübit VR 35 (EP RuK=88.0° C.), Manufacturer/Supplier: GKG MINERALOEL HANDEL GmbH & Co. KG Stuttgart, Liebknechtstr. 50, 70565 Stuttgart (Germany)

Rough density of the asphalt mixture (after adding 7.0 M.-% bitumen) 2.546 g/cm$^3$ mixing temperature ≦190° C. (in mixer)

Installation temperature approx. 180° C. (after mixing and transport)

The surface texture of a roadway topcoat made from the mastic asphalt mixture according to the invention has such a favorable appearance that significant noise reduction is expected when compared to the known mastic asphalt mixture, and also in particular compared to asphalt covering layers that were classified until now as low noise, e.g., mastic asphalt with stone chippings. The flat surface having relatively flat-lying stone chippings reduces the rolling noise of vehicles. A favorable pore space arises at the surface by rolling with the light smooth roller. This also helps drainage when moisture is present. The noise reduction of an an asphalt covering layer formed with the asphalt mixture according to the invention is so favorable that the Dstro-value (correction value for various road surfaces according to RLS-90—Guidelines for noise control on roadways), is to be set equal to the one open pore asphalt, $D_{StrO}$-5 dBA.

The invention claimed is:

1. A self-compressing asphalt mixture for roadway topcoats, asphalt intermediate layers, asphalt binder layers and/or asphalt sealing layers, comprising:

stone chippings, sand, a filler, and a binding agent that form a self-compressing mastic asphalt mixture, wherein the total mass of all components in the self-compressing mastic asphalt mixture is 100 M.-%, wherein the stone chippings have grain size >1 mm and form 65 M.-% to 80 M.-% of the self-compressing mastic asphalt mixture; wherein the sand includes at least one of natural sand and crushed sand having a grain size in a range that is >0.063 mm and ≦2 mm and form 6 M.-% to 12 M.-% of the self-compressing mastic asphalt mixture; wherein the filler has an aggregate ≦0.063 mm and forms 15 M.-% to 19.5 M.-% of the self-compressing mastic asphalt mixture and consists essentially of limestone; and further wherein the binding agent forms 6.8 M.-% to 7.5 M.-% of the self-compressing mastic asphalt mixture.

2. The self-compressing mastic asphalt mixture of claim 1, wherein the sand consists essentially of natural sand.

3. The self-compressing mastic asphalt mixture of claim 1, wherein the binding agent includes at least one of a bitumen, a thermoplastic binding agent, or mixtures thereof.

4. The self-compressing mastic asphalt mixture of claim 1, wherein the binding agent includes a bitumen and the bitumen includes at least one of a bitumen for making low-temperature asphalt, a polymer-modified bitumen, and a bitumen for road construction.

5. The self-compressing mastic asphalt mixture of claim 3, wherein the binding agent includes a bitumen and a viscosity modifying agent to increase the viscosity of the bitumen.

6. A roadway topcoat, asphalt intermediate layer, asphalt binder layer, or asphalt sealing layer comprising the self-compressing mastic asphalt mixture of claim 1.

7. A method for installing a roadway topcoat, asphalt intermediate layer, asphalt binder layer and/or asphalt sealing layer made from a self-compressing mastic asphalt mixture, the method comprising:

providing a self-compressing mastic asphalt mixture for roadway topcoats, asphalt intermediate layers, asphalt binder layers and/or asphalt sealing layers, wherein the self-compressing mastic asphalt mixture comprises stone chippings, sand, a filler, and binding agent, wherein the total mass of all components in the self-compressing mastic asphalt mixture is 100 M.-%, wherein the stone chippings have a grain size >1 mm and form 65 M.-% to 80 M.-% of the self-compressing mastic asphalt mixture; wherein the sand includes at least one of natural sand and crushed sand having a grain size in a range that is >0.063 mm and ≦2 mm and form 6 M.-% to 12 M.-% of the self-compressing mastic asphalt mixture; wherein the filler has an aggregate ≦0.063 mm and forms 15 M.-% to 19.5 M.-% of the self-compressing mastic asphalt mixture and consists essentially of limestone; and further wherein the binding agent forms 6.8 M.-% to 7.5 M.-% of the self-compressing mastic asphalt mixture; and installing at least a layer of the self-compressing mastic asphalt mixture.

8. The method of claim 7, wherein the installing includes installing the self-compressing mastic asphalt mixture at a temperature of between approximately 180° C. and 230° C.

9. The method of claim 7, wherein the installing includes installing the self-compressing mastic asphalt mixture at a temperature of between approximately 180° C. and 200° C.

10. The method of claim 7, wherein the installing includes installing the layer of the self-compressing mastic asphalt mixture utilizing a road paver.

11. The method of claim 10, wherein the method includes utilizing the road paver to produce a slight precompression of the layer.

12. The method of claim 11, wherein the layer is a roadway topcoat.

13. The method of claim 7, wherein after the installing, the method further comprises treating the layer with a light smooth roller.

14. The method of claim 13, wherein the light smooth roller weighs less than 6 tonnes.

15. The method of claim 7, wherein the layer is a roadway topcoat, and further wherein the method further comprises applying a lane marking to the roadway topcoat.

16. The method of claim 7, wherein the providing includes transporting the self-compressing mastic asphalt mixture to an installation site utilizing at least one of trucks with built-in insulating and/or heating devices and trucks without a mixing device for the self-compressing mastic asphalt mixture.

17. The method of claim 14, wherein the light smooth roller weighs less than 4 tonnes and is utilized to orient the stone chippings in the layer.

18. The method of claim 17, wherein the method does not include compressing the layer with a heavy roller.

19. The method of claim 11, wherein apart from the slight precompression provided by the road paver, the method does not include providing additional compression to the layer to achieve sufficient compression for use of the layer as a roadway topcoat.

* * * * *